US006657164B1

(12) United States Patent
Koch

(10) Patent No.: US 6,657,164 B1
(45) Date of Patent: Dec. 2, 2003

(54) CUSTOMIZABLE HEATED INSOLE

(75) Inventor: Albin G. Koch, Davos (CH)

(73) Assignee: Hotronic International Limited, Davos (CH)

( * ) Notice: Subject to any disclaimer, the term of this patent is extended or adjusted under 35 U.S.C. 154(b) by 0 days.

(21) Appl. No.: 10/274,362

(22) Filed: Oct. 21, 2002

(51) Int. Cl.[7] ..... H05B 1/00
(52) U.S. Cl. ..... 219/211; 36/2.6
(58) Field of Search ..... 219/211, 523, 219/528; 36/2.6, 43; 607/111

(56) References Cited

U.S. PATENT DOCUMENTS

| | | | | | |
|---|---|---|---|---|---|
| 3,663,796 | A | * | 5/1972 | Hines et al. | 219/211 |
| 3,867,611 | A | * | 2/1975 | Riley | 219/523 |
| 3,906,185 | A | * | 9/1975 | Gross et al. | 219/211 |
| 4,080,971 | A | * | 3/1978 | Leeper | 607/111 |
| 4,094,080 | A | | 6/1978 | Sanders | |
| 4,579,103 | A | | 4/1986 | Poffenbarger | |
| 4,910,881 | A | | 3/1990 | Baggio et al. | |
| 4,948,951 | A | * | 8/1990 | Balzano | 219/528 |
| 5,067,255 | A | * | 11/1991 | Hutcheson | 36/43 |
| 5,140,131 | A | * | 8/1992 | Macher et al. | 219/211 |
| 5,230,170 | A | * | 7/1993 | Dahle | 36/2.6 |
| 5,285,586 | A | | 2/1994 | Goldston et al. | |
| 5,331,688 | A | | 7/1994 | Kiyohara | |
| 5,495,682 | A | * | 3/1996 | Chen | 36/2.6 |
| 5,623,772 | A | * | 4/1997 | Sunderland et al. | 36/2.6 |
| 5,642,574 | A | | 7/1997 | Caddy | |
| 5,722,185 | A | * | 3/1998 | Vigneron | 36/2.6 |
| 5,829,171 | A | | 11/1998 | Weber et al. | |
| 5,893,991 | A | * | 4/1999 | Newell | 219/211 |
| 5,956,866 | A | | 9/1999 | Spears | |
| 6,094,844 | A | | 8/2000 | Potts | |
| 6,218,644 | B1 | * | 4/2001 | Zorn et al. | 219/211 |

* cited by examiner

*Primary Examiner*—Teresa Walberg
*Assistant Examiner*—L Fastovsky
(74) *Attorney, Agent, or Firm*—Roylance, Abrams, Berdo & Goodman, LLP

(57) ABSTRACT

Heated insoles are presented in the form of separate packages that will combine into a kit to make a heated insole for footwear. One package contains a heating assembly made of a heating element, a flexible power cable ending in an electrical connector, and (optionally) a power pack that contains a rechargeable battery, a rheostat, and a mating electrical connector. The other package contains a flexible, cushioned insole having a sealable opening and guide channel on the bottom. Once a suitable sized insole is selected, the heating element is inserted into a sealable opening in the insole that is dimensioned to receive the heating element and sealed therein. This kit and manner of construction allows retailers to stock fewer heating elements than insole sizes so as to reduce inventory costs.

11 Claims, 3 Drawing Sheets

CUSTOMIZABLE HEATED INSOLE

FIELD OF THE INVENTION

The invention relates to an electrically heated warming system for use in cold environments using rechargeable batteries as a source of electrical energy.

BACKGROUND OF THE INVENTION

Many sports and activities are conducted outdoors under cold and possibly harsh conditions. Examples include snow skiing, hunting, ice skating, ice fishing, etc. Many occupations also involve exposure to similar conditions. In each circumstance, the body will respond to cold temperatures by directing blood flow to maintain core body temperature even though the extremities, hands and feet, may suffer discomfort.

A variety of products have been sold as sources of warmth for the extremities that may be used in boots, mittens, and gloves. Some of the products rely on slow chemical reactions that produce a range of heat output based on exposure to oxygen. Such products can be made inexpensively but are bulky and require a certain minimum rate of air flow or volume of air for proper operation. Chemical heat sources are not well suited for use in form fitting ski boots and typically are not designed to be reusable once depleted.

Another type of product relies on a battery current flowing through a resistive heat element to produce heat in the vicinity of the resistive element. Some products have a fixed current flow. Others have a variable rate of current flow. Both types of units, however, use batteries connected to the resistive element by a flat wire so that the battery pack is located outside the article of clothing. Battery packs for ski boots are often clipped on the back or outside of the boot by a spring clip.

Current versions of commercially available electrically heated insoles are thin and flat with an electrical heating element adhered at the forward end (at optimal toe placement) between a top layer of thin material and a cushioned bottom layer. See, U.S. Pat. No. 5,140,131 whose disclosure is herein incorporated by reference. A flat electrical cable ran beneath the insole from the heating element to the trailing edge beneath the cushioned layer, up the back of the boot between the inner boot and outer shell, and out the top to a battery clipped outside the boot. It was thought that a thin, flat insert, i.e., one free of anatomical features for providing contoured foot support, would be more desirable to avoid interference with the existing contoured insoles specifically made for relatively highly engineered ski and work boots. Adhesion of the heating element between the insole layers assured correct and secure placement of the element.

Unfortunately, there are some disadvantages to the conventional electrically heated thermal insoles. One is the trend towards more form-fitting ski boots that may become uncomfortable if even a thin thermal insole is added inside the foot chamber. Such close quarters in the foot chamber may also allow the users with some foot shapes to feel the flat cable running the length of the insole. Removal of the engineered insole reduces comfort. It would be desirable to have a heated insole for shoes, boots, and other footwear used in cold temperatures that could be customized to meet the size, shape, and support needs of almost any user for almost any activity.

What it gains in manufacturing quality and consistency with the thermal element, however, the conventional electrically heated thermal insole loses in flexibility. Retailers need to stock one complete thermal insole for each size boot they expect to sell. Because the thermal element and attached electrical cable is the more expensive component, ski boot retailer will need to make a significant investment in thermal insole inventory to be considered fully stocked for the entire range of ski boot sizes through any designated period in the skiing season. The user is also faced with an impossible choice: risk reduced comfort and fit for extended skiing time with the thermal insole rather than the original engineered insole for the boot.

It would be desirable to have a method for supplying an inventory of electrically heated thermal insole that could be stocked in a variety of sizes and in a quantity sufficient to supply cyclical business demands with minimum capital investment in inventory.

It would also be desirable to have an electrically heater thermal insole design that would exhibit a construction design that would provide the user and the retail seller with a quality product and options not available with conventional pre-constructed thermal insoles.

SUMMARY OF THE INVENTION

Electrically heated thermal insoles according to the invention are in the form of a kit made of separate packages for (a) a flexible, electrically powered resistance heating assembly that contains the heating element electrically bonded to a flexible power cable which terminates in a power supply connector, and (b) a flexible, cushioned footwear insole of extended length with a toe end and a heel end and having an upper layer bonded to a cushioned bottom layer, wherein the cushioned bottom layer exhibits a flap opening and a channel extending from the flap opening to the heel end of the insole for guiding the flexible power cable along the length of the insole. The inside of this flap is dimensioned to receive the heating element of the heating assembly and is covered with an adhesive which is, in turn, covered with a removable barrier film whereby insertion of the heating element, removal of the barrier, and closure of the flap opening will seal the heating element in the insole.

Electrically heated thermal insoles according to the invention are provided in the form of separate packages for the universally-sized heating assembly and for the sized insole. This separation of heating element and insole allows the retailer to stock a relatively few number of heating elements and a wide variety of relatively inexpensive sized insole units which may have the conventional flat profile for general use or may be contoured for an engineered fit for a particular type of footwear or foot shape. When the proper insole is selected, the user or the retailer install the heating element within the insole by introducing the heating element into the opening created by the insole flap, removing the barrier film to expose the adhesive, and sealing the heating element within the insole. When the heating element and power cord are aligned properly, the power cord lies in an outer channel formed into the bottom outside surface of the cushioned insole and extends from the embedded heating element to the heel end of the insole, up the back of the shoe or boot, and to an electrical connector suitable for forming a mated electrical connection with a control pack containing a battery, the mating electrical connector, and, preferably, an adjustable rheostat.

The heated insole kit and components of the invention offer advantages not previously available. With the kit of the present invention, retailers can reduce their investment in inventory by stocking a relatively limited number of universally-sized heating element assemblies and a wide variety of insoles of different sizes and shapes for more a precise matching to the user's particular needs. Users receive a heated insole product that fits better and is better suited to their cold weather sporting needs.

DETAILED DESCRIPTION

Figure 1:
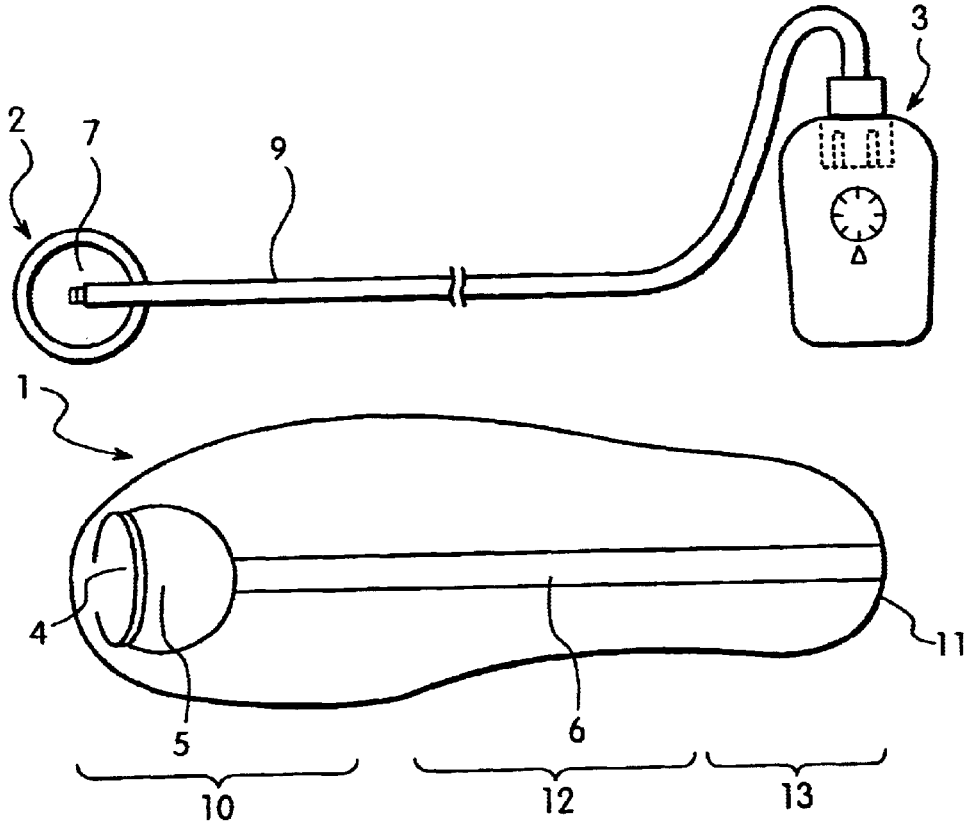
FIG. 1 shows the kit of the invention containing, as separate components, a cushioned insole, a heating assembly, and a battery pack. An associated recharger for the battery pack is not illustrated.

Heated insoles according to the invention are made available in the form of a kit of two or more discrete units. One unit contains the heating assembly, and the other contains the flexible, cushioned footwear insole. A power pack assembly can be combined with one of these packages or made available as a third unit. These units can be grouped or made available individually for reduced inventory costs and greater flexibility for the users in selecting a heated insole suitable for the particular needs of the user.

See, U.S. Pat. No. 6,218,644 whose disclosure is incorporated herein by reference.

Briefly described, the heating element comprises a resistor with electrical leads and a distributor made of a top layer, a central layer, and a bottom layer which are laminated together. The resistor is a conventional electrical component used in heated insoles and whose sole function is to convert electrical energy from the direct current of a battery into sensible heat that is laterally distributed over the target foot surfaces (usually the toes and front of the foot). The resistor is typically used in the form of an integrated circuit or microchip whose heat output is proportional to the applied voltage.

The top and bottom layers of the distributor are flexible, highly heat conductive, and formed of a metal having a heat conductive coefficient within the range from about 80–100. Copper is a particularly preferred material for the top and bottom layers.

The center layer is a flexible carrier that provides structural integrity to the heating element and insulates the top and bottom layers, both electrically and thermally. A preferred central layer is made of a fiberglass laminate having a low heat conduction coefficient, e.g., a coefficient of less than 1, preferably within the range from about 0.20 to about 0.30. The central layer, acts as a momentary heat dam and storage structure, which aids in distributing the heat across the surface of the heating element for warming of the user's toe area.

Advantageously, the heating element can also comprise a first thin coating of water-resistant material to seal the heating element against moisture and the problems associated with an electrical circuit in close proximity to the human foot. These coatings resist corrosion of the top and bottom layers and can be transparent, but will not degrade under heating nor interfere with heat conduction of the heating element. A variety of lacquers and sealants are commercially available that will provide a flexible, water impervious coating for the electrical contacts and surfaces.

The power cable is preferably flat, has two conductive wires, is highly flexible, and is cut to a sufficient length to extend from the toe of a large boot insole, across the bottom in a channel formed into the bottom of the insole, up the back of a relatively tall ski boot, with enough remainder to allow a terminating electrical connector to be attached to a battery pack located in the upper half of the total height of the ski boot. A power cable length within the range of about 50–80 cm should be generally adequate. If desired, one or more wires or high tensile fibers can be secured to or molded into the power cable as a structural member for bearing the tensile load forces placed on the power cable in normal use.

The matable electrical connector at the end of the power cable can take virtually any configuration that is able to connect with the battery pack to form a reasonably firm, water resistant connection. Suitable connections can include dual prong male/female connectors, twist-to-lock connections, threaded fittings, and the like.

The cushioned insole is a composite having a relatively thin top layer of soft woven or nonwoven material that readily conducts heat and a relatively thicker bottom layer of one or more cushioning materials that do not readily conduct heat. The cushioning material can be formed as a relatively flat surface generally shaped as footprint or may be formed to exhibit surface contours and engineered support surfaces that provide additional support to the user's foot.

The battery pack unit includes a rechargeable battery power supply in a water tight enclosure with a rheostat for adjusting the electrical output and an electrical connector that will mate with the connector on the flexible power cable. The particular type of battery can include any form of rechargeable battery that is sufficient to provide adequate power output in ambient temperatures of 20° F. (−6° C.) or less. Exemplary materials include nickel cadmium, nickel metal hydride, and the like.

The present invention represents a new method that allows the needs of the user to be matched with the best heated insole product without additional cost to the retailer. In particular, the retailer can select and collect an inventory of relatively inexpensive insole units of a wide variety of sizes or size ranges and flat or supportingly contoured configurations.

Each insole will have an opening and a correspondingly shaped, adhesive covered flap to receive the heating element of a heating assembly. A barrier film over the adhesive on the flap prevents the flap from sealing the opening in the insole. The heating element is inserted into the insole opening, usually with the resistance chip facing away from the user's foot and extending into the cushioning material of the covering flap,so that the power cable attached to the heating element extends out of the opening and into a channel formed into the bottom surface of the insole. This channel extends longitudinally over the length of the insole from the opening to the heel end of the insole and is laterally positioned on the insole to prevent both twisting of the power cable and lateral movement outside the channel when the user is engaging in physical activities that may involve fairly fast or significant foot movements.

When the barrier film is removed to expose the adhesive, the flap is lowered over the heating element to seal the heating element within the insole opening. Because the adhesive will be in contact with an electrical connection, the adhesive should not be electrically conductive and is desirably water resistant to provide additional protection against contact of moisture with the power connection for the heating element.

The insole can be trimmed to reduce the length and/or width or both either before or after installation of the heating element within the opening. Preferably, any adjustments in particular dimensions, as for a custom fit, or for adjusting the insole to a smaller standard shoe size will occur before the heating element is installed. The delay provides additional safeguards for the heating element in the event of trimming errors and saves the cost of the heating element in the event of any trimming errors.

The invention is conveniently described with reference to the attached figures and in the context of an insole insert suitable for a skiing boot. It will be understood that similar structural features and components will be designated with the same reference numeral and that all references to a "boot" will also be applicable to other footwear in which the heated insole of the invention is used. The relative terms "top" and "bottom" will be used to describe a spatial orientation generally considered to be most comfortable in use. It is possible, however, to use the insoles in an opposite orientation: in such a circumstance, the terms "top" and "bottom" will refer to their opposite surfaces.

Insole 1, heating assembly 2, and battery pack 3 are shown as separate, unassembled components. Insole 1 is a generally foot-shaped configuration with a toe region 10, midsole region 12, and heel area 13. The view shown in FIG. 1 is toward the bottom of insole 1.

Flap 4, corresponding opening 5, and channel 6 are formed in the bottom of insole 1. Opening 5 is dimensioned to receive resistance heating element 7 and become secured therein when barrier film 8 is removed and flap 4 is closed. It will be understood that opening 5 and the corresponding flap 4 can be formed with many possible shapes provided that the dimensions thereof are sufficient to receive heating element 7 and secure it when sealed. When heating element 7 is secured in opening 5, power cable 9 extends from opening opened 5 at toe region 10 into and down the length of channel 6 to the heel end 11 of insole 1 and will further extend up out of the boot and into a mating electrical connection with battery pack 3 that is secured to the outside of the user's boot. This separation of components and insole design allows users or retailers to select an insole size and design which is later combined with a heating assembly 2 in an aligned configuration to provide a good fit with correct installation of the heating assembly 2 within insole 1.

Figure 2:
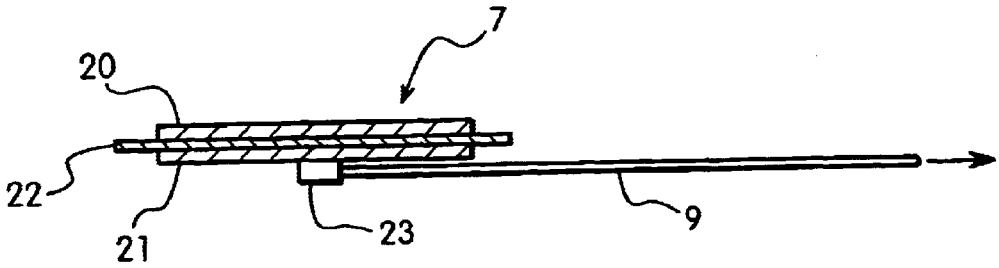
FIG. 2 depicts a cross sectional view of a typical heating element and associated power cord.

FIG. 2 illustrates a laminated structure for heating element 7. Top layer 20 and bottom layer 21 are made of a heat conductive material, typically a metal like copper or a metallic alloy, that can be formed or deposited on insulative carrier 22. Resistive heating chip 23 receives direct current electrical energy via power cable 9 and produces sensible heat that is laterally distributed via top layer 20 and bottom layer 21 across and anywhere within the toe area i.e., the ball of the foot and forward to, and including the toes. It is intended that heating chip 23 will be mounted within opening 5 so that heating chip 5 is away from the user's foot and extends into the cushioned material 30 of insole 1.

Figure 3:
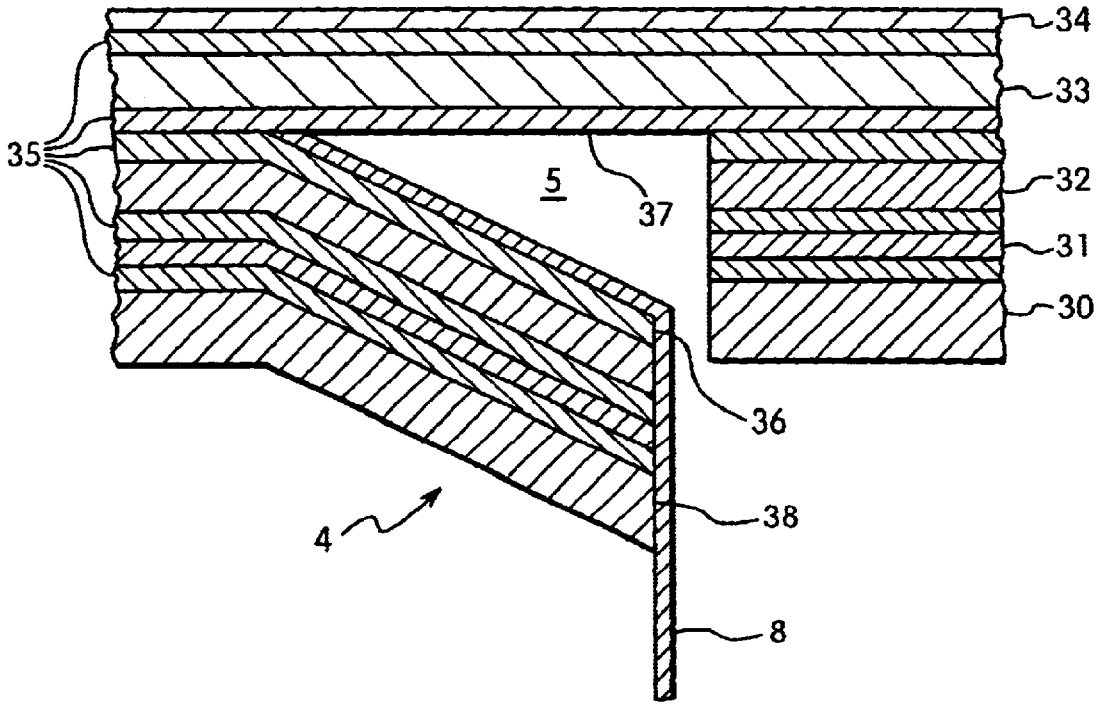
FIG. 3 is a cross sectional view of the toe end of an insole with an open flap with adhesive for receiving and securing the heating element therein.

FIG. 3 presents an enlarged cross sectional view of the toe region 10 of insole 1. Insole 1 is preferably made of a multi-layer construction adhered to form an integral laminate that includes (from sole bottom to sole top) firm foam layer 30 of adequate density and rigidity to provide support for a user's foot and structural integrity to the shaped insole, first covering fabric or nonwoven layer 31, second foam layer 32 of open cell foam or equivalent with lesser density than firm foam later 30 but adequate to provide comfort and thermal insulation against the heat loss downwardly thru firm foam layer 30, third foam layer 33 of open cell foam or equivalent with a thickness and density best suited for user comfort and providing less thermal insulation than second foam layer 32, and top layer 34 of woven or nonwoven fabric. Adhesive layers 35 may be the same or different adhesive composition and are used to laminate the various layers together. Preferably, adhesive layers 35 are the same environmentally acceptable self adhesive that is chemically compatible with the materials used in successive layers of the laminate.

Barrier film 8 covers adhesive layer 35 in region 36 on second foam layer 32 of flap 4 and prevents contact with adhesive in region 37 on third foam layer 33 until barrier film 8 is removed. When heating element 7 is formed so that it is smaller than and does not completely fill opening 4, adhesive in region 36 bonds to adhesive in region 37 around the perimeter of heating element 7 and seals heating element 7 within opening 5. Optionally and as shown in FIG. 3, barrier film 8 can be folded to cover the exposed laminate edge 38 to facilitate insertion of heating element 7 into opening 5.

Figure 4:
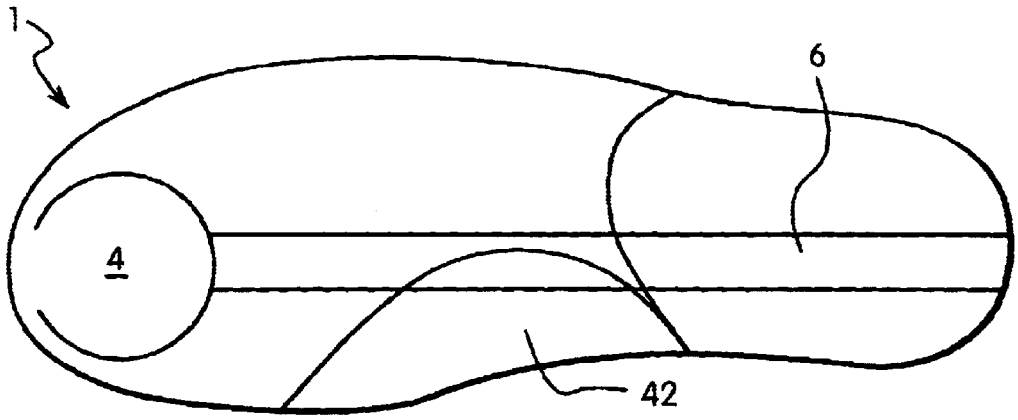
FIGS. 4 and 5 illustrate a cushioned insole having anatomically supportive contours formed therein.
Figure 5:
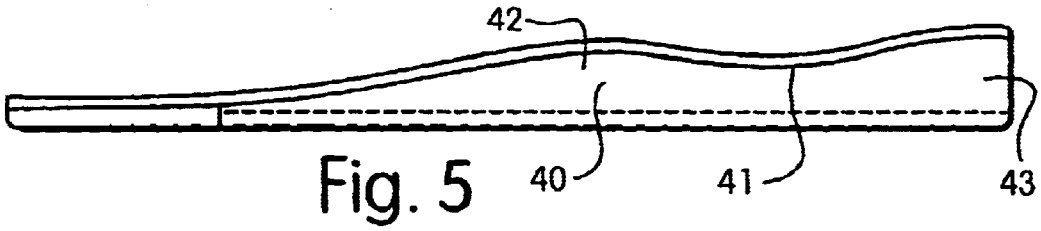

FIGS. 4 and 5 illustrate insole 1 having insole 1 formed with a plurality of anatomically supportive surface rises 40 and valleys 41. Insole 1 can be formed with multiple areas of differing densities for enhanced user comfort. For example, arch area 42 may be formed to exhibit a lower or higher density than heel cushioning 43.

Figure 6:
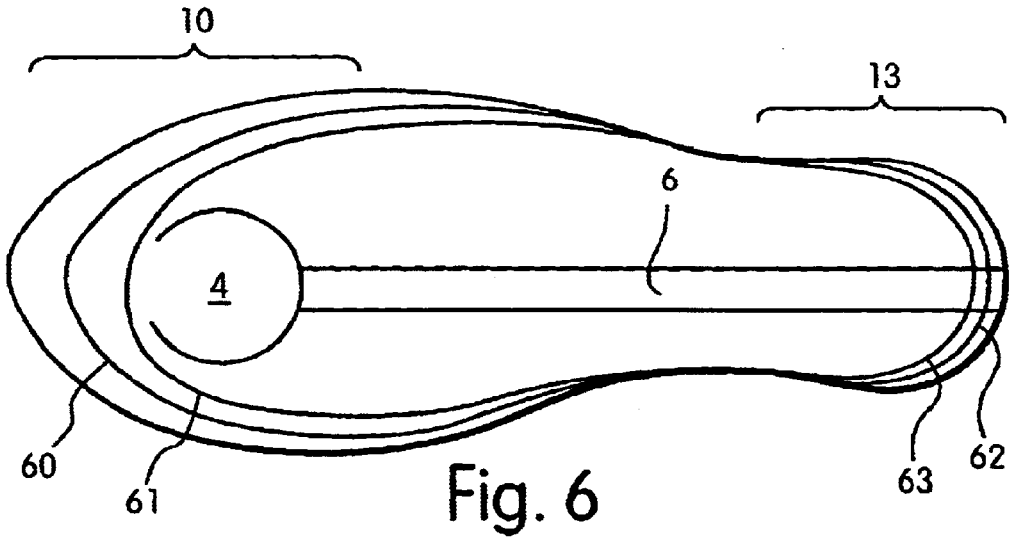
FIGS. 6 and 7 show a cushioned insole having a flat cross sectional profile with indentations formed into the insole for adjusting the size of the insole.
Figure 7:
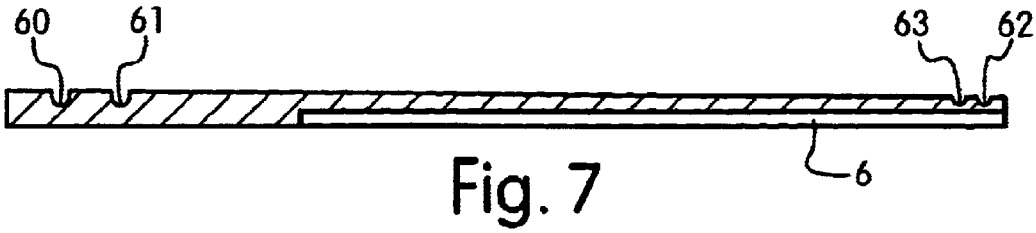

FIGS. 6 and 7 depict insole 1 with grooves 60, 61 formed into toe region 10 for the purpose of providing guidance in the proper trim lines for reducing the size of insole 1 by one standard shoe size (grooves 60) or two standard shoe sizes (grooves 61). When insole 1 is formed in a flat profile, as shown in these figures, grooves 62 and 63 may be formed in heel area 13 to provide guidance for those users who need to narrow or shorten the heel area. Instead of physical grooves formed into the material, size adjustment markings can also be imprinted on the surface of insole 1 on either the top or bottom surfaces.

In any event, the number of sizes by which insole 1 can be adjusted is functionally limited by the ability of h eating element 7 to be positioned near the user's toes and to distribute heat across the toe area. Too much insole length on the toe end of opening 5 will not permit an adequate amount of heat to reach the user's toes and may adversely affect comfort in cold situations. Thus, it is generally advised that insole 1 be modified no more than one or two sizes from the original size.

Insole 1 is preferably formed with a plurality of laminating steps and/or sub-steps. An exemplary combination of parallel process steps includes the following steps: the formation of a first laminate sub-assembly made with first and second foam layers 30, 32 on either side of fabric or nonwoven layer 31. This first laminate sub-assembly is then coated with adhesive layer 35 over second foam layer 32 and covered in its entirety with one or more pieces of barrier film 8. One or more die cutting steps then cuts flap 4 into and through the first laminate sub-assembly including barrier film 8. Barrier film 8 is then removed from the adhesive covered surface of the first laminate sub-assembly except for that portion of barrier film 8 covering region 36.

The first laminate sub-assembly having flap 4 cut therein is then laminated to a second laminate sub-assembly that comprises third foam layer 33 and top layer 34. Preferably, the first laminate sub-assembly is provided with machine-readable key markings or indicia that allow the machine to determine where flaps 4 have been cut into the first sub-assembly so that insoles can be cut for proper positioning of flap 4 on insole 1 after the fist and second sub-assembly laminates are joined.

What is claimed is:

1. Electrically heated thermal insole kits containing:

a. a flexible, electrically powered resistance heating assembly having a heating element electrically bonded to an extended flexible power cable and which terminates in a power supply connector, and b. a flexible, cushioned footwear insole of extended length with a toe end, a heel end, and having an upper layer bonded with an adhesive to a cushioned bottom layer wherein the cushioned bottom layer exhibits a flap, an associated opening, and an external channel extending from the flap opening to the heel end of the insole for guiding the flexible power cable along the length of the insole to the heel end of the insole.

2. The kit of claim 1 wherein said opening is dimensioned to receive the heating element of the heating assembly.

3. The kit of claim 1 wherein one side of said flap is coated with an adhesive which is covered with a removable barrier film whereby insertion of the heating element into said opening, removal of the barrier, and closure of the flap opening will seal the heating element between the upper layer and the cushioned bottom layer.

4. The kit of claim 1 wherein said insole exhibits a flat longitudinal side profile.

5. The kit of claim 1 wherein said insole exhibits a contoured longitudinal side profile.

6. The kit of claim 1 wherein said heating element is generally circular in shape.

7. The kit of claim 1 further comprising a battery power pack having a rechargeable battery and a mating power supply connector.

8. The kit of claim 1 wherein said insole further exhibits markings at the toe end for reducing the size of said insole.

9. A method for fitting an electrically powered, heated insole to a user comprising the steps of:

a. selecting a cushioned insole dimensioned for a particular range of shoe sizes and bearing a guide at a toe end of said insole for reducing said insole to a smaller size, wherein said insole exhibits an extended length and width with a toe end and a heel end, b. inserting a resistance heating element into an opening in a bottom side of said insole and aligning said element therein whereby an extended flexible power cable extends out of said opening and across the length of said insole in a channel formed in a bottom side of said insole, c. removing a barrier film from an adhesive layer on a flap shaped to seal said heating element in said opening, and d. sealing said heating element within said insole.

10. A method according to claim 9 further comprising: trimming said insole to a desired size.

11. A method for making a footware insole able to receive a thermal heating element, said method comprising the steps of:

a. cutting a flap opening in a first cushioned laminate having at least one layer of cushioning foam, at least one layer of adhesive, and at least one barrier film covering said adhesive layer, b. laminating the first laminate sub-assembly to a second laminate sub-assembly by adhesion with adhesive on said first laminate sub-assembly that is not protected by said barrier film thereby forming an opening pocket between the first and second laminate sub-assemblies that can be accessed through said flap opening.

* * * * *